US005961163A

United States Patent [19]

Brackmann et al.

[11] Patent Number: 5,961,163

[45] Date of Patent: Oct. 5, 1999

[54] MOTOR-VEHICLE DOOR LATCH WITH ANTITHEFT PROTECTION

[75] Inventors: Horst Brackmann, Velbert; Klaus Feist, Wuppertal; Armin Handke, Duisburg; Rainer Kipka, Essen, all of Germany

[73] Assignee: Kiekert AG, Heiligenhaus, Germany

[21] Appl. No.: 08/893,692

[22] Filed: Jul. 11, 1997

Related U.S. Application Data

[63] Continuation-in-part of application No. 08/709,097, Sep. 6, 1996, abandoned.

[30] Foreign Application Priority Data

Sep. 8, 1995 [DE] Germany ..... 19533199

[51] Int. Cl.[6] ..... E05C 3/26

[52] U.S. Cl. ..... 292/201; 292/216

[58] Field of Search ..... 292/201, 216, 292/336.3, DIG. 3, DIG. 23, DIG. 27

[56] References Cited

U.S. PATENT DOCUMENTS

| | | | |
|---|---|---|---|
| 4,440,006 | 4/1984 | Kleefeldt | 70/264 |
| 4,538,845 | 9/1985 | Yamada | 292/216 |
| 4,756,563 | 7/1988 | Garwood et al. | 292/216 |
| 4,904,006 | 2/1990 | Hayakawa et al. | 292/DIG. 27 X |
| 4,974,886 | 12/1990 | Kleefeldt et al. | 292/216 X |
| 4,978,154 | 12/1990 | Kleefeldt | 292/201 |
| 5,046,341 | 9/1991 | Ogino et al. | 292/216 X |
| 5,078,436 | 1/1992 | Kleefeldt et al. | 292/216 X |
| 5,100,185 | 3/1992 | Menke et al. | 292/216 |
| 5,188,406 | 2/1993 | Sterzenbach et al. | 292/216 |
| 5,409,277 | 4/1995 | Rogers | 292/336.3 |
| 5,419,597 | 5/1995 | Brackmann et al. | 292/216 X |
| 5,454,608 | 10/1995 | Dzurko | 292/216 |
| 5,474,340 | 12/1995 | Brackman | 292/216 |
| 5,538,298 | 7/1996 | Ikeda | 292/201 |

FOREIGN PATENT DOCUMENTS

| | | | |
|---|---|---|---|
| 0 267 423 | 5/1988 | European Pat. Off. . | |
| 267 423 B1 | 1/1994 | European Pat. Off. . | |
| 1 064 845 | 9/1959 | Germany . | |
| 1064845 | 9/1959 | Germany | 292/DIG. 23 |
| 2 911 680 | 10/1980 | Germany . | |
| 291 680 | 10/1980 | Germany | 292/216 |
| 1 004 592 | 3/1983 | U.S.S.R. . | |
| 1004592 | 3/1983 | U.S.S.R. | 292/DIG. 23 |

*Primary Examiner*—Steven Meyers
*Assistant Examiner*—Gary Estremsky
*Attorney, Agent, or Firm*—Herbert Dubno; Andrew Wilford

[57] ABSTRACT

A motor-vehicle door latch has a latching fork and a release pawl engageable with the fork and pivotal between a latched position retaining the fork in a latched position engaged around a bolt and an unlatched position in which the fork can release the bolt. A coupling lever is pivotal between a coupling position connecting an actuating lever to the release pawl for actuation of the release pawl by the actuating lever and a decoupling position in which movement of the actuating lever does not move the release pawl. An inside locking lever pivotal between a locked and unlocked position is connected by a coupling to a central-locking lever also pivotal for joint synchronous pivoting thereof. A spring engaged between the locking lever and the coupling lever normally moves the coupling lever into its decoupling position on movement of the locking lever into its locked position. A control pin movable in an orbit is operatively engageable with the central-locking lever to displace the locking lever into the locked position and an antitheft lever on the coupling lever is engageable with the control pin. The control pin is moved in its orbit into an antitheft-on position engaging and displacing the antitheft lever and pivoting the coupling lever via the antitheft lever into the decoupling position so that, when the locking lever is in the unlocked position, movement of the coupling lever into the decoupling position loads the spring.

13 Claims, 6 Drawing Sheets

MOTOR-VEHICLE DOOR LATCH WITH ANTITHEFT PROTECTION

CROSS REFERENCE TO RELATED APPLICATION

This application is a continuation-in-part of copending application 08/709,097 (now abandoned) filed Sep. 6, 1996 with a claim to the priority of German application 195 33 199.0 filed Sep. 8, 1995.

FIELD OF THE INVENTION

The present invention relates to a motor-vehicle door latch. More particularly this invention concerns such a latch having an antitheft feature.

BACKGROUND OF THE INVENTION

A standard motor-vehicle door latch has a housing, a latching fork pivotal on the housing, and a release pawl engageable with the fork and pivotal on the housing between a latched position retaining the fork in a latched position engaged around a bolt and securing a motor-vehicle door closed and an unlatched position in which the fork can release the bolt and allow the door to open. Inside and outside actuating levers controlled by inside and outside door handles are pivotal on the housing between actuated and an unactuated positions. A coupling lever is pivotal between a coupling position connecting the actuating levers to the release pawl for actuation of the release pawl by the actuating levers and a decoupling position in which movement of the actuating levers into their actuated positions does not move the release pawl. Inside and outside locking levers are pivotal on the housing between locked and unlocked positions. A central-locking lever pivotal on the housing is connected by a coupling engaged to the inside locking lever for joint synchronous pivoting thereof. The coupling lever can be pivoted by the locking levers into the decoupling position to disconnect the actuating levers from the release pawl and, therefore, lock the latch.

The central-locking lever is typically controlled by a pin that moves along an orbit, traveling in one direction to lock the latch and another to unlock it. The outside locking lever is set up so that it can override the centrally locked position so that, if the vehicle loses power, the doors can still be opened. Normally this central-locking unit is operated by a central controller in turn operated by a remote control, typically with an infrared link, so that the vehicle can be unlocked simply by pressing a button on the remote. Such a lock is described in European patent document 0,267,423.

To date such latches are not provided with an antitheft feature, which is a setting in which the latch is locked and can only be unlocked by means of the outside locking lever. Thus in the antitheft position a would-be thief who breaks the window of the door cannot reach in and unlock the door. Instead it will remain locked even if the inside handle and/or door-lock button are manipulated.

OBJECTS OF THE INVENTION

It is therefore an object of the present invention to provide an improved motor-vehicle door latch.

Another object is the provision of such an improved motor-vehicle door latch which overcomes the above-given disadvantages, that is which has an antitheft feature.

SUMMARY OF THE INVENTION

A motor-vehicle door latch has according to the invention a housing, a latching fork pivotal on the housing, and a release pawl engageable with the fork and pivotal on the housing between a latched position retaining the fork in a latched position engaged around a bolt and securing a motor-vehicle door closed and an unlatched position in which the fork can release the bolt and allow the door to open. An actuating lever is pivotal on the housing between an actuated and an unactuated position and a coupling lever is pivotal between a coupling position connecting the actuating lever to the release pawl for actuation of the release pawl by the actuating lever and a decoupling position in which movement of the actuating lever between its positions does not move the release pawl. An inside locking lever pivotal on the housing between a locked and unlocked position is connected by a coupling to a central-locking lever also pivotal on the housing for joint synchronous pivoting thereof. A spring engaged between the locking lever and the coupling lever normally moves the coupling lever into its decoupling position on movement of the locking lever into its locked position. A control pin movable in an orbit is operatively engageable with the central-locking lever to displace the locking lever into the locked position and an antitheft lever on the coupling lever is engageable with the control pin. The control pin is moved in its orbit into an antitheft-on position engaging and displacing the antitheft lever and pivoting the coupling lever via the antitheft lever into the decoupling position so that, when the locking lever is in the unlocked position, movement of the coupling lever into the decoupling position loads the spring.

Thus with this system the antitheft lever actuates the coupling lever by displacing it into the decoupling position whenever the pin moves into the antitheft position. This otherwise conventional latch therefore has an antitheft position that is provided by adding only a few minor parts to it.

According to the invention the antitheft lever is pivoted on the coupling lever and has a hook end engageable with the pin. A toggle spring engaged between the coupling and antitheft levers retains the antitheft lever alternately in a normal position engageable with the pin and an emergency-unlock position not engageable with the pin. An outside locking lever displaceable between a locked and an unlocked position is connected by a lost-motion coupling to the inside locking lever, and formations on the antitheft lever and outside locking lever displace the antitheft lever into the emergency-unlock position on displacement of the outside locking lever into the unlocked position.

The motor-vehicle door latch further has according to the invention a switch lever engageable with the pin in the antitheft-on position, a switch operable by the switch lever when engaged by the pin, and a spring urging the switch lever out of engagement with the switch.

The door latch wherein the door latch wherein the inside locking lever and central locking lever are coaxially pivoted on the housing.

The door latch wherein the door latch wherein the outside locking lever is coaxially pivoted on the housing with the inside locking and central locking levers.

The door latch wherein the door latch wherein the central-locking member is formed with a cutout in which the pin is engaged and which is formed with control surfaces and blocking surfaces engageable by the pin, a portion of the orbit of the pin lying outside the cutout. The pin lying against one of the blocking surfaces in the antitheft-on position.

The door latch wherein the cutout flares toward a pivot axis of the central locking element.

The door latch wherein the pin is orbitable through about 360° and lies in a rest position outside the cutout.

The door latch wherein the coupling between the central locking lever and inside locking lever is releasable.

The door latch wherein the coupling is an elastic snap coupling that can release when, in the locked position of the locking lever. The central-locking lever is pivoted into an unlocked position.

The door latch wherein the coupling lever is coaxially pivoted with the inside locking lever.

The motor-vehicle door latch further has according to the invention an outside actuating lever adjacent the inside actuating lever. Each of the actuating levers is formed with a throughgoing hole and a release lever pivoted on the coupling lever, has a coupling pin engaged through the holes of the actuating levers, and an entrainment formation engageable with the release pawl only in the coupling position of the coupling lever.

BRIEF DESCRIPTION OF THE DRAWING

The above and other objects, features, and advantages will become more readily apparent from the following description, reference being made to the accompanying drawing in which:

FIG. 3 is a view like FIG. 2 but with the latch locked and the antitheft feature on.

SPECIFIC DESCRIPTION

Figure 1:
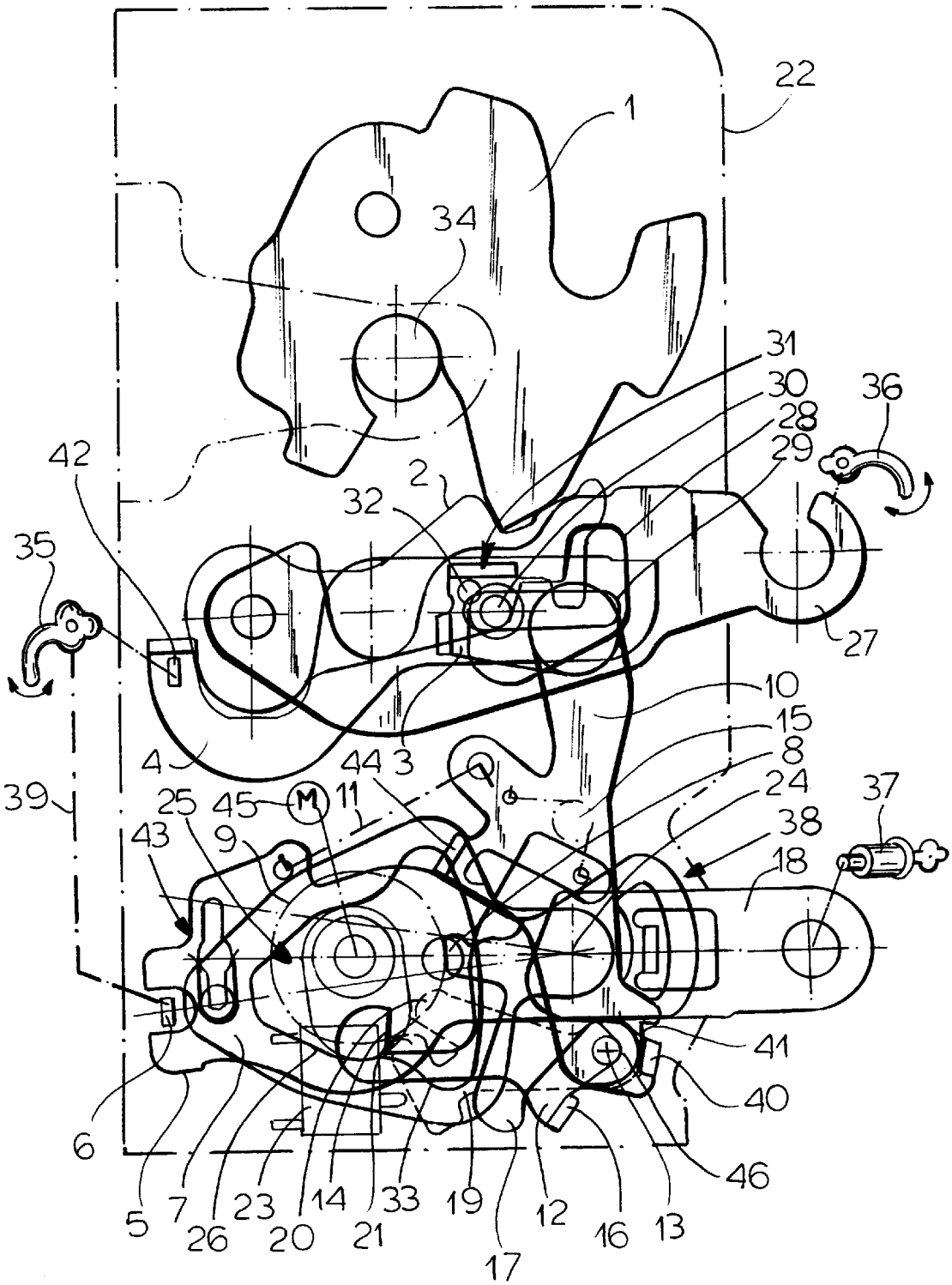
FIG. 1 is a partly diagrammatic side view illustrating the latch according to the invention in the unlocked position.
Figure 1A:
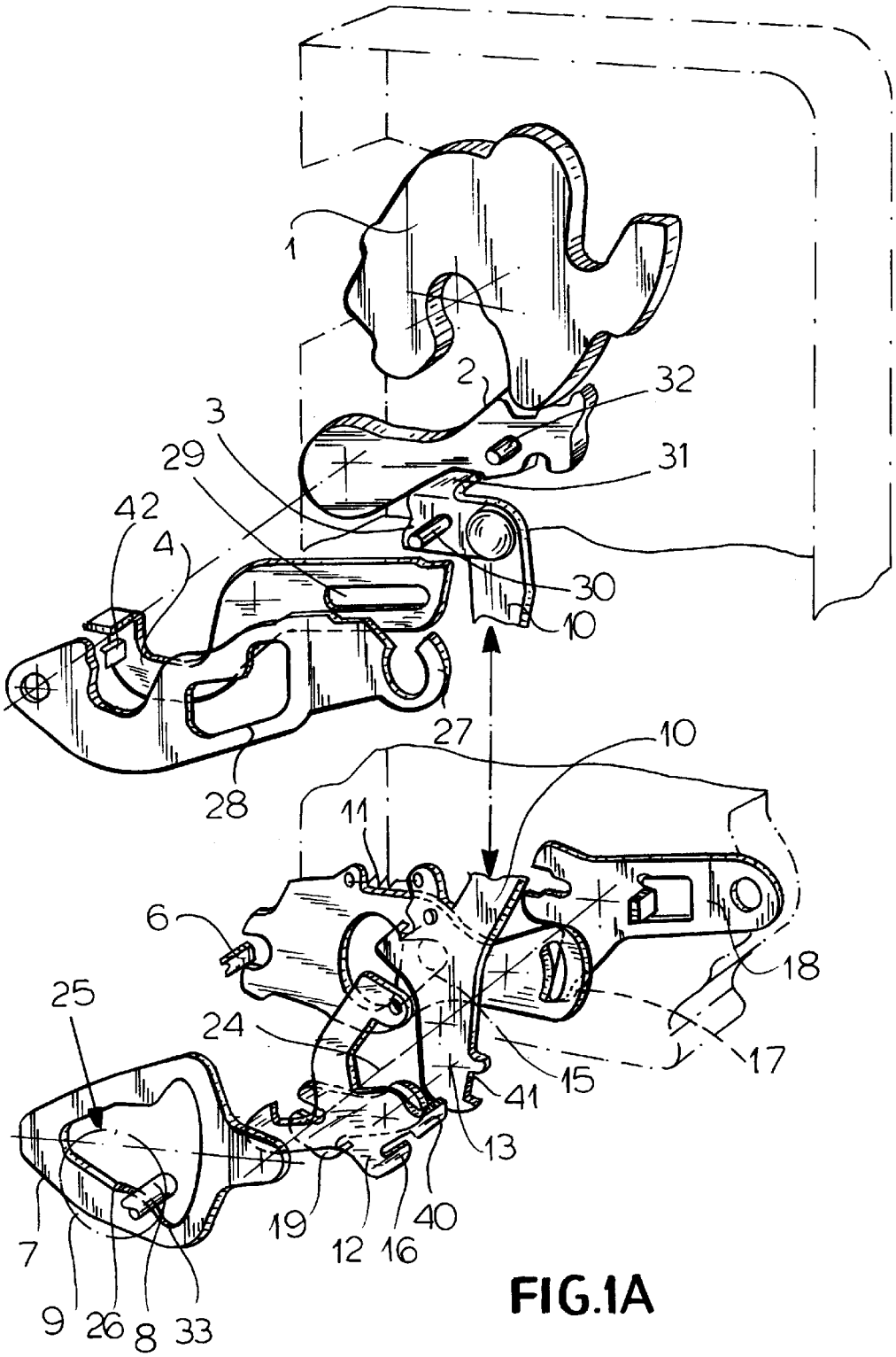
FIGS. 1A and 1B are exploded views further illustrating the latch.
Figure 1B:
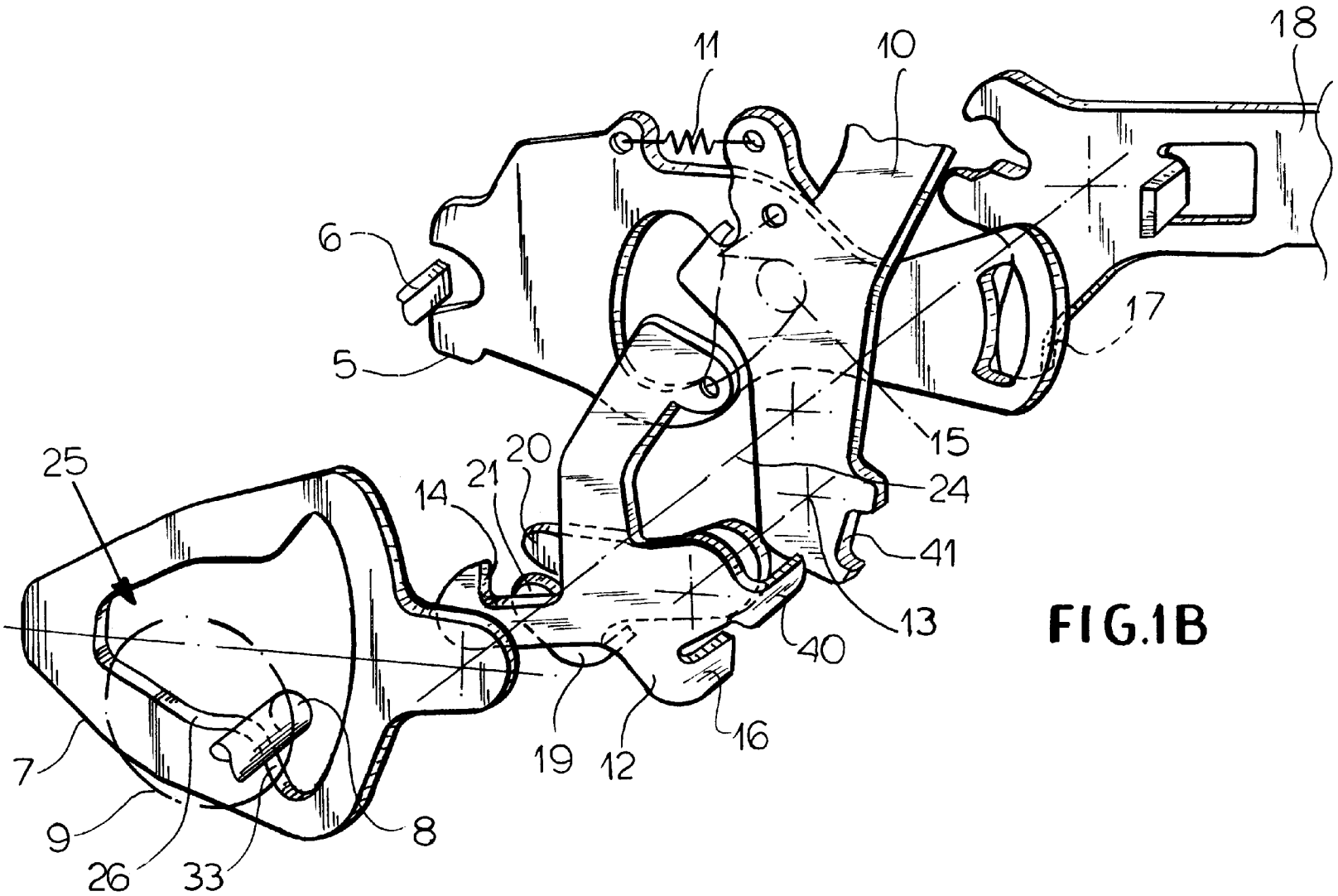

As seen in FIGS. 1, 1A, and 1B a door latch of the type generally described in copending application Ser. No. 08/503,404 filed Jul. 17, 1996 (now U.S. Pat. No. 5,634,677) has a pivotal fork 1, a release pawl 2 both pivoted on a housing 22 and a release lever 3 all serving to hold and retain a bolt 34 mounted on a door post. In addition it is provided with an actuating-lever system and a locking-lever system. The actuating-lever system more particularly has an inside actuating lever 4 operated via a lever 42 from an inside handle 35 and an outside actuating lever 27 operated by an outside handle 36. The locking-lever system has an inside locking lever 5 that can be actuated by a lever 6 in turn operated via a linkage 39 (see U.S. Pat. No. 5,683,125) from the inside handle 35 as well as by an outside locking lever 18 operated by an outside locking cylinder 37. The outside locking lever 18 as well as the inside locking lever 5 are pivotal about a common axis 24 and a lost-motion coupling 38 connects the levers 5 and 18.

Also mounted on the pivot axis 24 is a coupling lever 10 which connects the locking lever system with the actuating lever system. The coupling lever 10 is connected via a tension spring 11 with the inside locking lever 5 and bears via a tab 44 on the main locking lever 5 so that it normally pivots therewith. This force-transmitting connection via the spring 11 is set up such that the motor-vehicle door latch can be locked even if the outside actuating lever 27 and/or the inside actuating lever 4 are in the actuated positions.

The outside actuating lever 27 has a generally L-shaped cutout 28 and the inside actuating lever 4 has a longitudinally extending slot 29. The release lever 3 is pivoted on the coupling lever 10 and is provided with a guide pin 30 projecting through both the L-shaped cutout 28 and the slot 29. A cam edge 31 on the release lever 3 serves for releasing the release pawl 2. The cam edge 31 stays in the unlocked position of the coupling lever 10 in operative engagement with a release pin 32 of the pawl 2. In the unlocked position the cam edge 31 of the coupling lever 10 is clear of the pin 32 of the pawl 2. In this manner the actuating levers 4 and 27 are disconnected in the locked position of the coupling lever 10, that is their actuation does not move the pawl 2.

The motor-vehicle door latch shown in FIG. 1 is further equipped with a central locking drive as well as with a central-locking element 7 connected to the locking lever system. The central locking drive is constituted as a reversible electric-motor 45 which has an eccentric control pin 8 movable along an orbit 9 left and right to displace the central locking element 7 between unlocked, locked, and antitheft positions. The central-locking element 7 has in particular a cutout 25 with lateral control surfaces 26 directed into the cutout 25 and confronting the control pin 8. The inside locking lever 5 and the central locking element 7 are connected to each other physically via an emergency connecting element 43 constituted as a spring clip on the element 7 and a pin on the lever 5. A part of the orbit 9 of the control pin 8 lies outside the cutout 25 of the central-locking element 7.

The central-locking element 7 has on each side of the cutout 25 a respective abutment surface 33 that extends generally tangentially of the axis 24 and is engageable with the control pin 8 to arrest it. The positions of the control pin 8 are limited by running up of the control pin 8 against one of the abutment surfaces 33 whereupon the electric-motor drive is cut off. This can be done by position-detecting switches and also by monitoring the increased current consumption of the motor 45 when the pin 8 engages one of the abutment surfaces 33. The inside-locking lever 5 is also pivotal about the axis 24. The cutout 25 of the central locking element 7 flares radially inwardly relative to the axis 24.

The emergency-unlocking/connecting element 43 is formed as a force-transmitting snap connection so that the connection between the inside-locking lever 5 and the central-locking element 7 is releasable only toward the unlocked position of the inside locking lever 5. The inside-locking lever 5 and the central-locking element 7 under normal conditions, that is with no out-of the ordinary outside influences, act like a single part. In the case of a blocking of the locked position of the central-locking element 7 it is still possible to effect an emergency unlocking by means of the outside cylinder 37. A sufficiently strong actuation of the inside-locking lever 5 via the lever 18 through the coupling 38 will disconnect the emergency-unlocking/connecting element 43 and will unlock the latch even if the central-locking element 7 is set in the locked or, as discussed below, antitheft position. A strong subsequent actuation of the inside-locking lever 5 into the locked position again connects up the emergency connector element 43. After restoration of the functionality of the motor drive (for example by charging of the vehicle's battery) the motor-vehicle door latch according to the invention is thus once again operational.

According to the invention the latch has an antitheft element 12 that is pivoted at an axis 13 on an end of the coupling lever 10. This element 12 has a blocking or abutment edge 14 engageable with the central-locking pin 8. A toggle spring 15 engaged between the element 12 and the lever 10 ensures that the element 12 can move between and is stable in a normal position and an emergency-unlock position described below. In addition the element 12 has a bent-out abutment tab 40 engaged with play in a somewhat wider notch 41 of the coupling lever 10 so that it can move between its positions independently of the lever 10. The antitheft element 12 further has a control edge 16 which is engageable with an arm 17 of the outside locking lever 18. Thus on pivoting of the outside lever 18 into the unlocked position the antitheft element 12 is moved against the force of its toggle spring 15 relative to the coupling lever 10 into its emergency-unlock position. The lost-motion coupling 38 between the outside locking lever 18 and the main locking lever 5 is effected by the coupling 38 and ensures a neutral central positioning of the outside locking lever 18.

In addition a switch lever 19 pivoted at the axis 13 with the antitheft lever 12 has an actuating element 20 engageable with the pin 8 and an arm 21 engageable with a switch 23 mounted on the housing 22. A spring shown schematically at 46 urges the lever 19 away from the switch 23. This switch 23 is therefore actuated whenever the latch is in the antitheft position.

The system operates as follows:

In the unlocked position of FIG. 1 the release lever 3 and coupling lever 10 are in their coupling positions so that, if either of the levers 4 or 27 is pivoted to move the pin 30 downward, the lever 3 will pivot downward and engage the pin 32, thereby pulling the pawl 2 into the release position and freeing the fork 1. Furthermore in this unlocked position if the pin 8 is orbited clockwise it will engage the hook end 14 of the lever 12 and push it to the left, thereby pivoting the lever 10 clockwise and shifting it into the decoupling position. Thus the central-locking drive 45 can lock the latch and, as described below, completely disable the inside and outside handles 35 and 36 even in the unlatched position of the latch.

Figure 2:
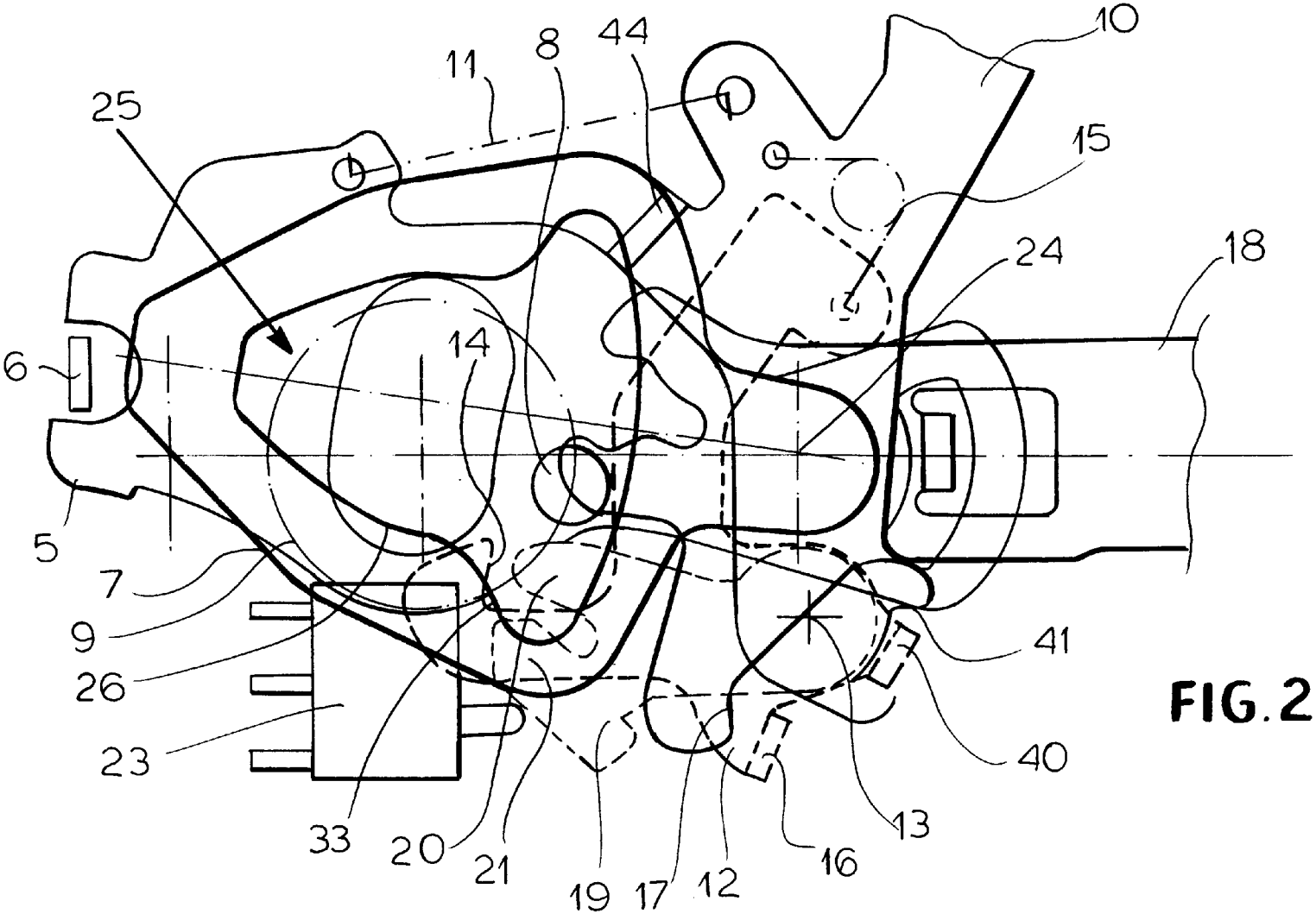
FIG. 2 is a view of a detail of the latch in the locked position.

As the system is moved by the handle 35 or 36 from the unlocked position of FIG. 1 to the locked position of FIG. 2 the main locking lever 5 is pivoted up, that is clockwise about its axis 24, so that it presses against the tab 44 of the coupling lever 10 and pushes it and the release lever 3 to the right. This moves the cam edge 31 out of the way of the pin 32 so that, even if the lever 4 or the lever 27 is pivoted to move the pin 30 down and thereby pivot the release lever 3 down also, the pin 32 will not be engaged and the latch will remain latched. In the FIG. 2 locked position the control pin 8 stands free of the edges of the cutout 25 so that the latch can still be moved back into the FIG. 1 unlocked position. Similarly if the pin 8 is orbited counterclockwise it will eventually engage the lower surface 26 and move the latch into the unlocked position. In other words, counterclockwise orbiting of the pin 8 normally unlocks the latch.

Figure 3:
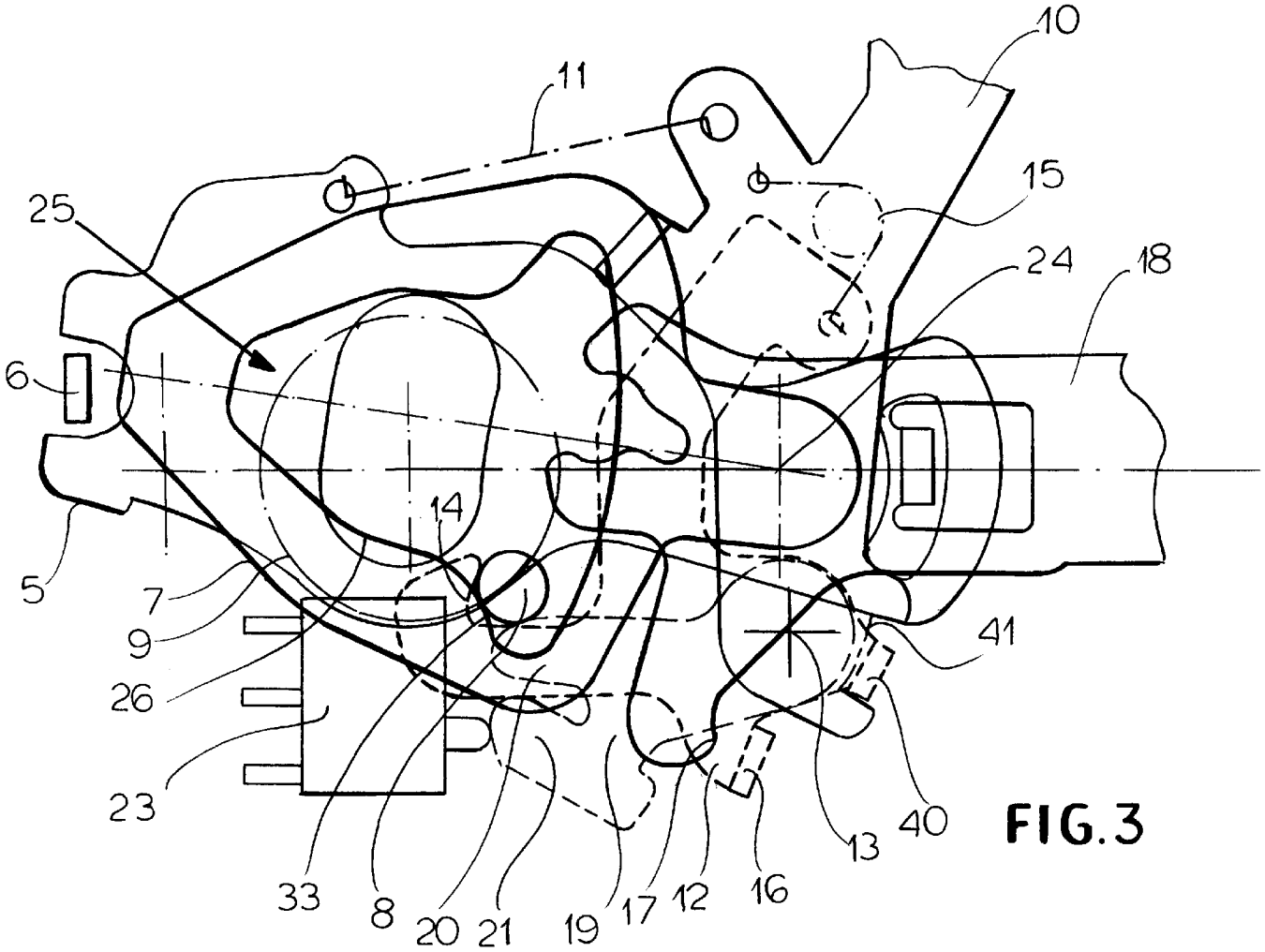
Figure 4:
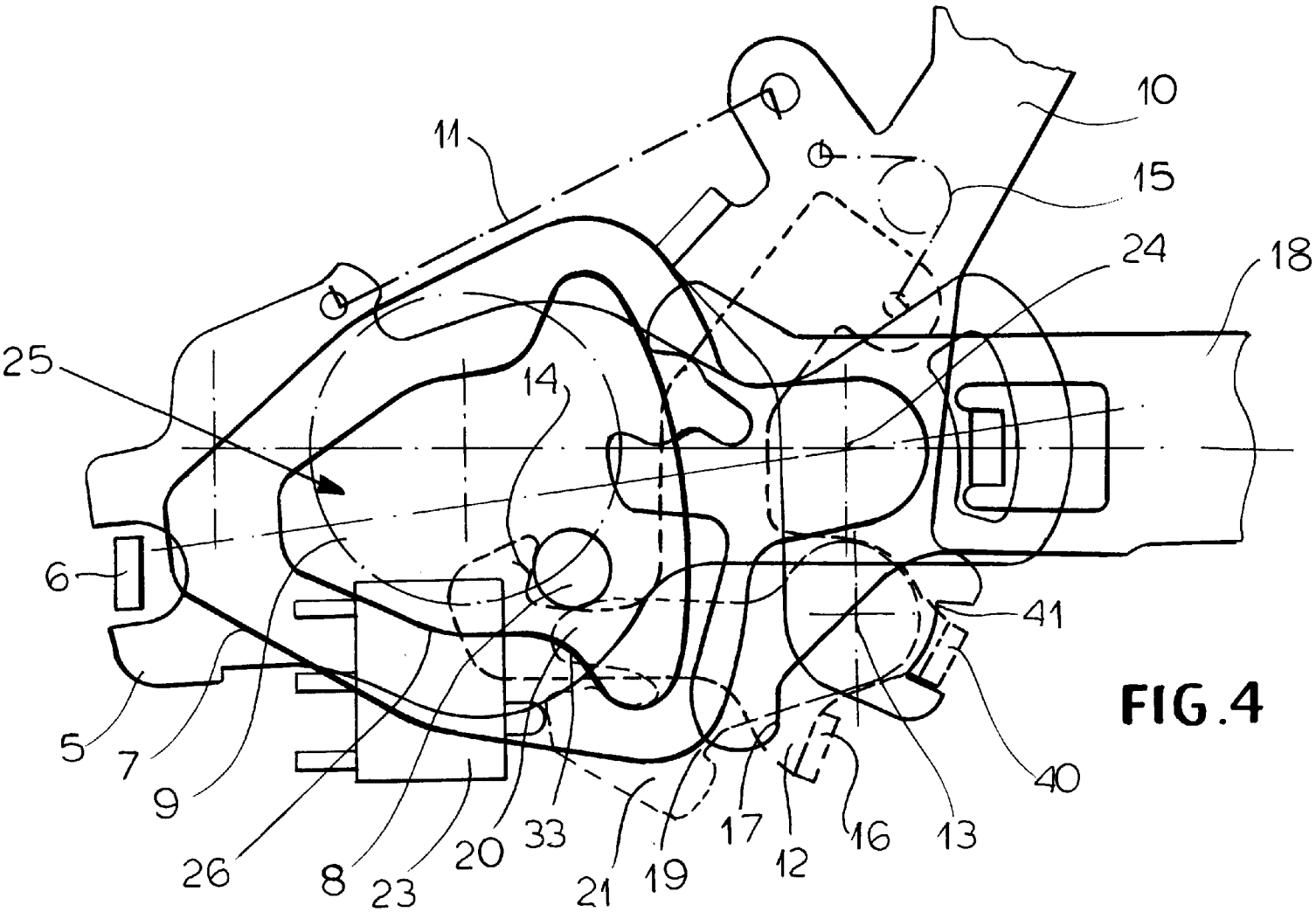
FIG. 4 is a view like FIG. 3 with the latch locked, the antitheft feature on, and the inside handle actuated.

When, however, in the locked position the pin 8 is orbited clockwise through another 45° to the FIG. 3 position, it engages both the edge 33 and the edge 14 of the lever 12 and assumes the antitheft-on position. Simultaneously it engages the arm 20 of the lever 19 and thereby actuates the switch 23 to signal to an unillustrated centralized controller that the latch is in the antitheft position. In this position even if the inside handle 35 is actuated as shown in FIG. 4, counterclockwise pivoting of the lever 5 will merely serve to stretch the spring 11 and to pull the edge 33 away from the pin 8, without unlocking or opening the door. Thus in the antitheft position, the inside door handle 35 is rendered inoperative both with respect to unlocking and unlatching the latch and of course the outside handle 36 is also decoupled.

We claim:

1. A motor-vehicle door latch comprising:

a housing;

a latching fork pivotal on the housing;

a release pawl engageable with the fork and pivotal on the housing between a latched position retaining the fork in a latched position engaged around a bolt and securing a motor-vehicle door closed and an unlatched position in which the fork can release the bolt and allow the door to open;

an actuating lever pivotal on the housing between an actuated and an unactuated position;

a coupling lever pivotal between a coupling position connecting the actuating lever to the release pawl for actuation of the release pawl by the actuating lever and a decoupling position in which movement of the actuating lever between its positions does not move the release pawl;

an inside locking lever pivotal on the housing between a locked and unlocked position;

a central-locking lever pivotal on the housing;

a coupling engaged between the central-locking lever and inside locking lever for joint synchronous pivoting thereof;

a spring engaged between the inside locking lever and the coupling lever and normally moving the coupling lever into its decoupling position on movement of the inside locking lever into its locked position;

a control pin movable in an orbit and operatively engageable with the central-locking lever to displace the inside locking lever into the locked position;

an antitheft lever on the coupling lever and engageable with the control pin; and means for moving the control pin in its orbit into an antitheft-on position engaging and displacing the antitheft lever and pivoting the coupling lever via the antitheft lever into the decoupling position, whereby when the inside locking lever is in the unlocked position movement of the coupling lever into the decoupling position loads the spring.

2. The motor-vehicle door latch defined in claim 1 wherein the antitheft lever is pivoted on the coupling lever and has a hook end engageable with the pin.

3. A motor-vehicle door latch comprising:

a housing;

a latching fork pivotal on the housing;

a release pawl engageable with the fork and pivotal on the housing between a latched position retaining the fork in a latched position engaged around a bolt and securing a motor-vehicle door closed and an unlatched position in which the fork can release the bolt and allow the door to open;

an actuating lever pivotal on the housing between an actuated and an unactuated position;

a coupling lever pivotal between a coupling position connecting the actuating lever to the release pawl for actuation of the release pawl by the actuating lever and a decoupling position in which movement of the actuating lever between its positions does not move the release pawl;

an inside locking lever pivotal on the housing between a locked and unlocked position;

a central-locking lever pivotal on the housing;

a coupling engaged between the central-locking lever and inside locking lever for joint synchronous pivoting thereof;

a spring engaged between the inside locking lever and the coupling lever and normally moving the coupling lever into its decoupling position on movement of the inside locking lever into its locked position;

a control pin movable in an orbit and operatively engageable with the central-locking lever to displace the inside locking lever into the locked position;

an antitheft lever pivoted on the coupling lever and having a hook end engageable with the control pin;

means for moving the control pin in its orbit into an antitheft-on position engaging and displacing the antitheft lever and pivoting the coupling lever via the antitheft lever into the decoupling position, whereby when the inside locking lever is in the unlocked position movement of the coupling lever into the decoupling position loads the spring; and a toggle spring engaged between the coupling and antitheft levers and retaining the antitheft lever alternately in a normal position engageable with the pin and an emergency-unlock position not engageable with the pin.

4. The motor-vehicle door latch defined in claim 3, further comprising:

an outside locking lever displaceable between a locked and an unlocked position;

a lost-motion coupling between the outside locking lever and the inside locking lever; and formations on the antitheft lever and outside locking lever for displacement of the antitheft lever into the emergency-unlock position on displacement of the outside locking lever into the unlocked position.

5. The motor-vehicle door latch defined in claim 3, further comprising a switch lever engageable with the pin in the antitheft-on position;

a switch operable by the switch lever when engaged by the pin; and a spring urging the switch lever out of engagement with the switch.

6. The motor-vehicle door latch defined in claim 4 wherein the inside locking lever and central locking lever are coaxially pivoted on the housing.

7. The motor-vehicle door latch defined in claim 6 wherein the outside locking lever is coaxially pivoted on the housing with the inside locking and central locking levers.

8. The motor-vehicle door latch defined in claim 1 wherein the central-locking lever is formed with a cutout in which the pin is engaged and which is formed with control surfaces and blocking surfaces engageable by the pin, a portion of the orbit of the pin lying outside the cutout, the pin lying against one of the blocking surfaces in the antitheft-on position.

9. The motor-vehicle door latch defined in claim 8 wherein the cutout flares toward a pivot axis of the central locking lever.

10. The motor-vehicle door latch defined in claim 1 wherein the coupling between the central locking lever and inside locking lever is releasable.

11. The motor-vehicle door latch defined in claim 10 wherein the coupling is an elastic snap coupling that can release when, in the locked position of the locking lever, the central-locking lever is pivoted into an unlocked position.

12. The motor-vehicle door latch defined in claim 1 wherein the coupling lever is coaxially pivoted with the inside locking lever.

13. A motor-vehicle door latch comprising:

a housing;

a latching fork pivotal on the housing;

a release pawl engageable with the fork and pivotal on the housing between a latched position retaining the fork in a latched position engaged around a bolt and securing a motor-vehicle door closed and an unlatched position in which the fork can release the bolt and allow the door to open;

an inside actuating lever pivotal on the housing between an actuated and an unactuated position;

a coupling lever pivotal between a coupling position connecting the inside actuating lever to the release pawl for actuation of the release pawl by the inside actuating lever and a decoupling position in which movement of the inside actuating lever between its positions does not move the release pawl;

an inside locking lever pivotal on the housing between a locked and unlocked position;

a central-locking lever pivotal on the housing;

a coupling engaged between the central-locking lever and inside locking lever for joint synchronous pivoting thereof;

a spring engaged between the inside locking lever and the coupling lever and normally moving the coupling lever into its decoupling position on movement of the inside locking lever into its locked position:

a control pin movable in an orbit and operatively engageable with the central-locking lever to displace the inside locking lever into the locked position;

an antitheft lever on the coupling lever and engageable with the control pin;

means for moving the control pin in its orbit into an antitheft-on position engaging and displacing the antitheft lever and pivoting the coupling lever via the antitheft lever into the decoupling position, whereby when the inside locking lever is in the unlocked position movement of the coupling lever into the decoupling position loads the spring;

an outside actuating lever adjacent the inside actuating lever, each of the actuating levers being formed with a throughgoing hole; and a release lever pivoted on the coupling lever, having a coupling pin engaged through the holes of the actuating levers, and having an entrainment formation engageable with the release pawl only in the coupling position of the coupling lever.

* * * * *